United States Patent [19]

Thibault

[11] 4,395,823

[45] Aug. 2, 1983

[54] SHELL FISH OPENER

[76] Inventor: Laurent Thibault, 912 Des Saules, St-Nicholas, Quebec, Canada, GOS 2Z0

[21] Appl. No.: 284,982

[22] Filed: Jul. 20, 1981

[51] Int. Cl.[3] ..... A47J 13/00

[52] U.S. Cl. ..... 30/120.1; 30/120.5

[58] Field of Search ..... 30/120.1, 120.5

[56] References Cited

FOREIGN PATENT DOCUMENTS 2231199 12/1974 France ..... 30/120.1

2238324 2/1975 France ..... 30/120.1

*Primary Examiner*—Harold D. Whitehead

*Assistant Examiner*—J. T. Zatarga

*Attorney, Agent, or Firm*—Alan Swabey; Robert Mitchell; Guy Houle

[57] ABSTRACT

The invention is concerned with a device for opening a shell fish of the type having two shell halves normally held closed against each other by a muscle. The device of the invention comprises means for supporting the shell fish with one shell half resting substantially flat on the support means, means on the support means for providing an abutment for the shell fish, and link means pivotally connected to the abutment means so as to permit pivotal movement of a free end portion of the link means toward and away from the support means. The device further includes lever means pivotally mounted intermediate the ends thereof to the free end portion of the link means so as to permit pivotal movement of one end of the lever means toward and away from the abutment means, and wedge means hinged to the other end of the lever means and adapted to contact the shell fish at the edge defined between the shell halves substantially opposite the abutment means. Movement of the aforesaid one end of the lever means in a direction away from the abutment means forces the wedge means to penetrate between the shell halves and thereby separate the shell halves to open the shell fish sufficiently to cause rupture of the muscle.

11 Claims, 7 Drawing Figures

SHELL FISH OPENER

BACKGROUND OF THE INVENTION

The present invention relates to a device for opening shell fishes of the type having two shell halves normally held closed against each other by a muschle, such as oysters, clams and the like.

Oyster shell openers hitherto known usually comprise a knife or wedge element adapted to be inserted at the edge defined between the two shell halves at one end of the oyster shell and an abutment for holding the shell at the other end thereof against the outward force exerted by wedge element during the opening operation. In one type of oyster opening tool which has been proposed, for instance, in Canadian Pat. Nos. 131,370 and 149,909, the wedge element is connected to a vertically swingable lever which is actuated by hand so as to force the wedge element to horizontally penetrate between the shell halves upon downward movement of the lever, thereby opening the oyster shell. Such implement, however, is generally bulky in construction and must be mounted for firm support such as by being clamped to a table or the like, and thus cannot be conveniently carried as such, for instance, in one's pocket.

A more readily transportable type of oyster opener which has been proposed in Canadian Patent No. 896,819 takes the form of a pair of pliers having one jaw member provided with the wedge element and the other jaw member with the abutment for the oyster shell. This type of oyster opener presents the disadvantage that only different oysters varying over a relatively narrow range of sizes and shapes can be effeciently opened since oysters of large sizes will require an impractical wide spacing of the handles of the pliers, thus resulting in great difficulty to close the jaw members to open the shell. Also, the manner in which the oyster is held between the jaw members does not provide a stable support while opposed forced are applied at localised points on the shell; as a result, the oyster can easily slip out of the jaw members.

In addition, most known oyster shell openers do not permit the shell to be completely opened in a single operation since it is often necessary after the shell halves have been separated apart to introduce through the small opening formed a knife so as to cut the oyster muscle.

SUMMARY OF THE INVENTION

Accordingly, it is an object of this invention to overcome the aforementioned drawbacks and to provide a shell fish opener which is simple of construction, can be conveniently carried on oneself and yet can effeciently open different shell fishes varying over a wide range of sizes and shapes.

It is another object of the invention to provide a shell fish opener which can also permit the shell halves to be separated apart and the fish muscle to be cut, in a single operation.

In accordance with the present invention, there is thus provided a device for opening a shell fish of the type having two shell halves normally held closed against each other by a muscle, comprising means for supporting the shell fish with one shell half resting substantially flat on the support means, means on the support means for providing an abutment for the shell fish, and link means pivotally connected to the abutment means so as to permit pivotal movement of a free end portion of the link means toward and away from the support means. The device of the invention further includes lever means pivotally mounted intermediate the ends thereof to the free end portion of the link means so as to permit pivotal movement of one end of the lever means toward and away from the abutment means, and wedge means hinged to the other end of the lever means and adapted to contact the shell fish at the edge defined between the shell halves substantially opposite the abutment means.

By moving the aforesaid one end of the lever means in a direction away from the abutment means, the wedge means is forced to penetrate between the shell halves and thereby separate the shell halves to open the shell fish sufficiently to cause rupture of the muscle.

BRIEF DESCRIPTION OF THE DRAWINGS

The invention is illustrated by way of example in the accompanying drawings, in which.

Figure 4:
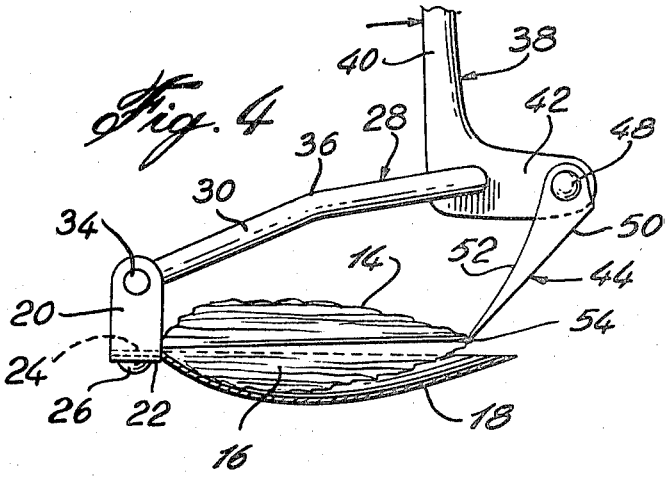
FIG. 4 is a fragmentary side elevation view of the oyster opener represented in FIG. 3.

A U-shaped link member 28 is pivotally connected to the abutment lugs 20 and 20' for pivotal movement relative to the support plate 18. The link member 18 has a pair of leg portions 30 and 30' interconnected by a bight portion 32, the leg portions 30 and 30' having respective outwardly bent end sections 34 and 34' extending through corresponding holes provided in the abutment lugs so as to permit pivotal movement of the link member 28. Leg portions 30 and 30' are each outwardly bent intermediate the respective ends sections 34 and 34' and the bight portion 32, at 36, in a direction away from the support plate 18 so as to provide a clearance for the upper shell half 14, as best shown in FIG. 4.

A L-shaped lever arm 38 having an elongated handle section 40 and a short section 42 carrying a wedge element 44 is pivotally mounted to the bight portion 32 of link member 28 so as to permit pivotal movement of the handle section 40 toward and away from the abutment lugs 20, 20'. To this end, the bight portion 32 extends through a hole provided in the lever arm 38 at the interconnection of the handle section 40 and the wedge holding section 42. The free end portion of the handle section 40 defines a bottle opener 46 for opening bottles of beer or the like beverage to accompany the tasting of oysters.

Figure 6:
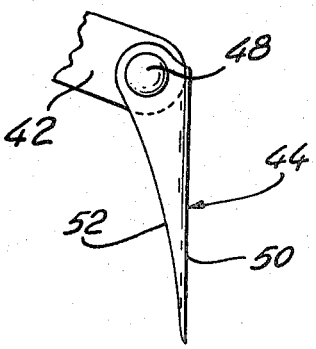
FIG. 6 is a fragmentary side elevation view showing particularly the wedge element used in the oyster opener represented in FIGS. 1–5.

The wedge element 44 is a straight longitudinally extending one-piece element having a U-shaped cross-section and is hinged to the free end of the section 42 of lever arm 38. As shown in FIG. 6, it is formed with a planar bottom surface 50 and an inclined top surface 52 progressively increasing in height relative to the planar surface 50 from its free end to its hinged end. The wedge element 44 is also provided with a sharp edge 54 at the apex thereof, as best shown in FIG. 3.

Figure 3:
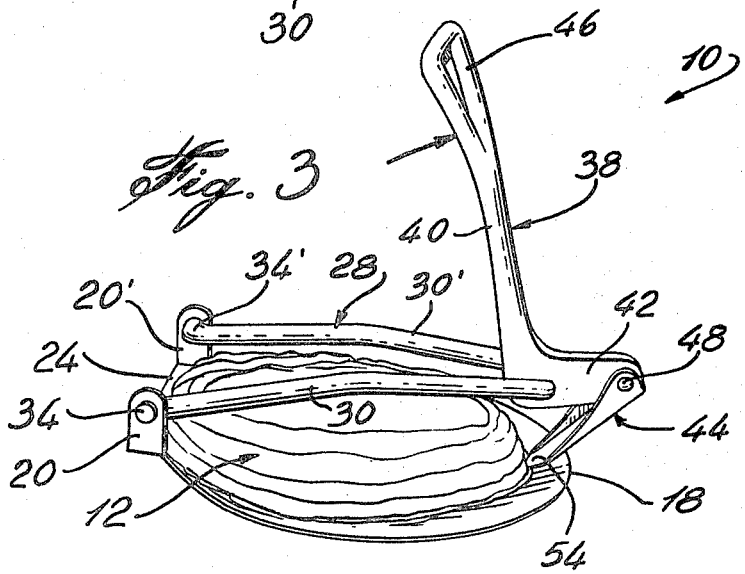
FIG. 3 is a perspective view showing the oyster opener of FIGS. 1 and 2 in position for opening an oyster shell.
Figure 5:
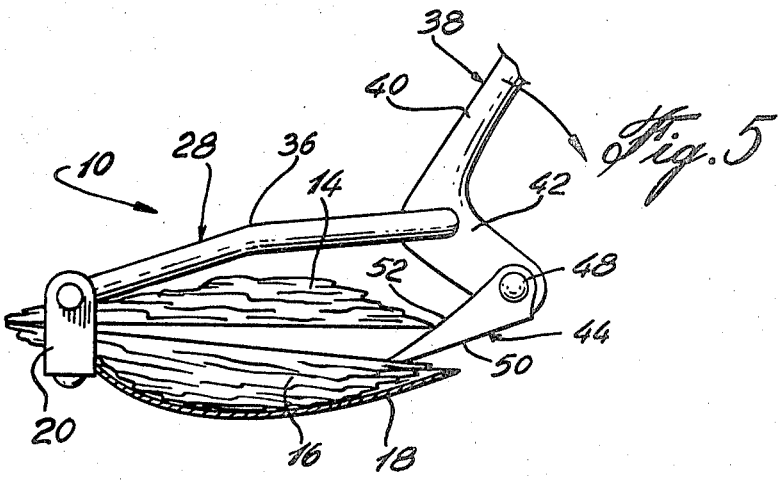
FIG. 5 is a view similar to that of FIG. 4, showing the oyster opener during the opening operation of the oyster shell.

To open an oyster shell 12, the shell is first positioned on the support plate 18 with its lower shell half 16 resting substantially flat on the plate and one end thereof abutting the lugs 20 and 20', as shown in FIG. 3. In the case of an oyster shell having a relatively large size, the space between the abutment lugs 20 and 20' enables an end portion of the shell to extend rearwardly of the oyster opener 10 and thus still permit proper positioning of the shell, as shown in FIG. 5. The sharp edge 54 of the wedge element 44 is then placed to contact the other end of the shell at the edge defined between the shell halves 14 and 16, as best shown in FIG. 4. The oyster opener 10 with the shell 12 therein can be disposed on a table or even on one's thigh for support and held there against with the palm of one hand pressing downwardly on the link member 28. Thereafter, the handle section 40 of the lever arm 38 is grasped by the other hand and moved downwardly in a direction away from the abutment lugs 20 and 20', thereby forcing the wedge element 44 to penetrate between the shell halves. As shown in FIG. 5, the wedge element penetrates at an angle relative to the mouth of the oyster shell, in a direction pointing towards the bottom of the lower shell half 16, the top surface 52 of the wedge element elevating the upper shell half 14 and the bottom surface thereof 50 holding the lower shell half 16 against the support plate 18 as the wedge element 44 progresses in its inclined position in a direction towards the abutment lugs 20 and 20'. Due to the angular penetration of the wedge element into the oyster shell, it is apparent that the wedge element need only penetrate to a small extent to open the shell sufficiently to cause rupture of the oyster muscle. Generally, an opening of about $\frac{3}{8}$–$\frac{1}{2}$ inch is sufficient to break the muscle.

Figure 7:
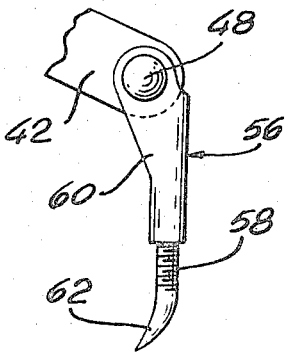
FIG. 7 is a view similar to that of FIG. 6, showing another form of wedge element for use with the oyster opener of FIGS. 1–5. cl DESCRIPTION OF PREFERRED EMBODIMENTS Referring to the drawings, and particularly to FIGS. 1–4 thereof, the oyster opener illustrated and generally designated by reference numeral 10, for opening an oyster shell 12 having upper and lower shell halves 14 and 16, comprises a concave support plate 18 for accomodating the lower shell half 16 such that the oyster shell is disposed substantially flat thereon. The support plate 18 is oval in shape and is provided at the rear end thereof with a pair of spaced-apart abutment lugs 20 and 20' disposed on the edge of the plate 18 and projecting upwardly therefrom. Lugs 20 and 20' are the respective arm portions of a one-piece U-shaped element having the bight portion 22 thereof secured to a planar rear flange 24 of the plate 18 by means of a pair of rivets 26 (only one shown).

When it is desired to open oyster shells which are irregularly shaped and have their natural opening angularly inclined with respect to the longitudinal axis thereof, the wedge element 44 is replaced by the wedge element 56 shown in FIG. 7, which is particularly adapted to this end. The wedge element 56 is a two-piece construction comprising an elongated threaded member 58 mounted to an attachment member 60 for axial rotation on its longitudinal axis. The member 58 has a wedge-shaped free end portion 62 angularly inclined relative to the longitudinal axis thereof. It is rotatably mounted by having the threaded portion thereof threadably engaging a threaded bore provided in the wedge attachment member 60. The attachment member 60 is hinged to the section 42 of lever arm 38 by the pivot pin 48, as in the previous case. With this particular arrangement, the wedge element can thus more easily follow an irregularly formed natural opening of the shell and open same.

Due to the spacing between the abutment lugs 20 and 20' and the pivotal arrangement between the wedge element 44 or 56, the lever arm 38 and the link member 28, it is apparent that the oyster opener 10 can accomodate between the abutment lugs 20 and 20' and the tip of the wedge element a variety of oyster shells differing over a wide range of sizes and shapes without hindering the leverage of the lever arm 38. Also, the spacing between lugs 20 and 20' and the central positioning of the wedge element 44 or 56 relative thereto enable the oyster shell to be rigidly held during the opening operation, thereby preventing the shell from slipping out of the oyster opener.

Figure 1:
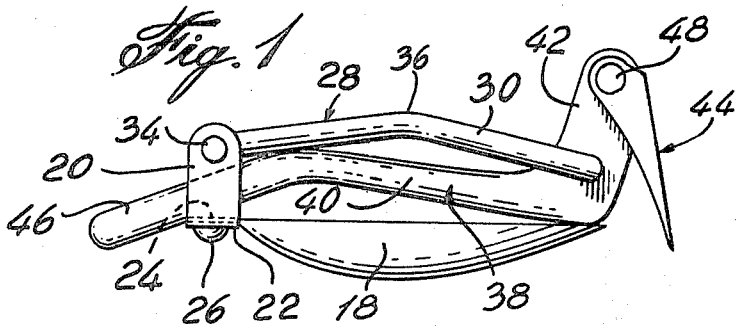
FIG. 1 is a side elevation view of an oyster shell opener according to the invention.
Figure 2:
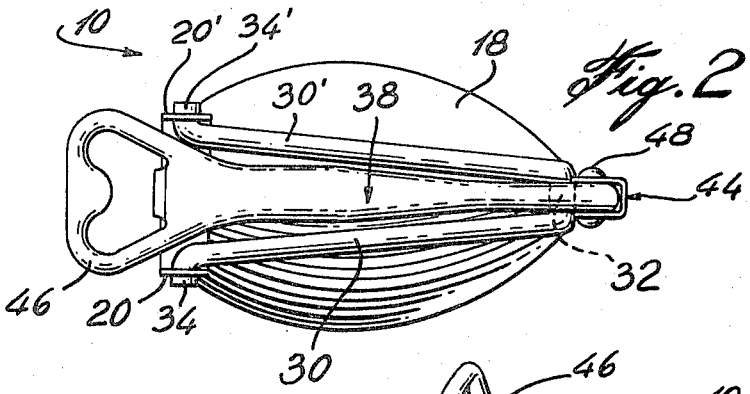
FIG. 2 is a top view of the oyster opener shown in FIG. 1.

When not in use, the handle section 40 of the oyster opener 10 can be conveniently folded over to lie between the respective legs portions 30 and 30' of the link member 28, thereby providing a compact structure, as shown in FIGS. 1 and 2. As an example of typical dimensions, the oyster opener when folded can have a length of about $5\frac{1}{2}$ inches, a width of about 3 inches and a height of about 2 inches. Thus such implement can be conveniently carried on oneself.

I claim:

1. A device for opening a shell fish of the type having two shell halves normally held closed against each other by a muscle, which comprises:

means for supporting said shell fish with one shell half resting substantially flat on said support means;

means on said support means for providing an abutment for said shell fish;

link means pivotally connected to said abutment means so as to permit pivotal movement of a free end portion of said link means toward and away from said support means;

lever means pivotally mounted intermediate the ends thereof to said free end portion of said link means so as to permit pivotal movement of one end of said lever means toward and away from said abutment means; and wedge means hinged to the other end of said lever means and adapted to contact said shell fish at the edge defined between said shell halves substantially opposite said abutment means, whereby movement of said one end of said lever means in a direction away from said abutment means forces said wedge means to penetrate between said shell halves and thereby separate said shell halves to open said shell fish sufficiently to cause rupture of said muscle.

2. A device according to claim 1, wherein said support means comprises a plate member.

3. A device according to claim 2, wherein said plate member is concave and adapted to accomodate at least a major portion of said one shell half.

4. A device according to claim 2, wherein said abutment means comprise a pair of spaced-apart lugs disposed on an edge of said plate member and protruding therefrom.

5. A device according to claim 4, wherein said link means comprises a U-shaped link member having a pair of leg portions interconnected by a bight portion, the respective end of said leg portions being pivotally connected to respective abutment lugs.

6. A device according to claim 5, wherein the respective leg portions of said U-shaped link member are outwardly bent intermediate the respective ends thereof and the bight portion, in a direction away from said plate member so as to provide a clearance for the other shell half.

7. A device according to claim 1, wherein said lever means comprises a L-shaped lever arm having an elongated handle section and a short wedge holding section, said lever arm being pivotally mounted to said link means at the interconnection of said handle section and wedge holding section.

8. A device according to claim 5, wherein said lever means comprises a L-shaped lever arm having an elongated handle section and a short wedge holding section, and wherein the bight portion of said U-shaped link member extends through an aperture provided in said lever arm at the interconnection of said handle section and wedge holding section so as to pivotally mount said lever arm.

9. A device according to claims 1, 7 or 8, wherein said wedge means comprises a straight longitudinally extending wedge element provided with a sharp edge of the apex thereof.

10. A device according to claims 1, 7 or 8, wherein said wedge means comprises an elongated member axially rotatable on its longitudinal axis and having a wedge-shaped free end portion angularly inclined relative to the longitudinal axis of said member.

11. A device according to claim 4, wherein said wedge means is pivotable in a plane lying centrally of said abutment lugs.

* * * * *